US005931106A

United States Patent [19]

Papajewski et al.

[11] Patent Number: 5,931,106

[45] Date of Patent: Aug. 3, 1999

[54] BUTTONHOLE SEWING MACHINE, WITH A NEEDLE-THREAD CLAMP AND CUTTER

[75] Inventors: Gerd Papajewski, Karlsruhe; Christian Möllenkamp, Bünde; Bernd Pofalla, Bielefeld, all of Germany

[73] Assignee: Durkopp Adler Aktiengesellschaft, Germany

[21] Appl. No.: 09/081,311

[22] Filed: May 19, 1998

[30] Foreign Application Priority Data

May 30, 1997 [DE] Germany ..... 197 22 504

[51] Int. Cl.[6] ..... D05B 3/06; D05B 65/02

[52] U.S. Cl. ..... 112/70; 112/253; 112/291

[58] Field of Search ..... 112/70, 76, 253, 112/293, 65, 68, 291, 294, 285, 286

[56] References Cited

U.S. PATENT DOCUMENTS

| | | | |
|---|---|---|---|
| 777,564 | 1/1904 | Sullivan . | |
| 4,404,921 | 9/1983 | Kastrup et al. | 112/291 |
| 4,502,404 | 3/1985 | Bisson . | |
| 4,919,061 | 4/1990 | Riss . | |
| 5,848,573 | 12/1998 | Hairano et al. | 112/70 |

*Primary Examiner*—Peter Nerbun
*Attorney, Agent, or Firm*—Lee Mann Smith McWilliams Sweeney & Ohlson

[57] ABSTRACT

A sewing machine, in particular a buttonhole sewing machine, is equipped with needle-thread-clamping scissors which have a lower half provided with a cutting edge at its tip portion. They further have an upper half pivotal relative to the lower half and having a cutting edge at its tip portion. Further, they have a clamping jaw to be pressed elastically on the tip portion of the upper half for clamping and holding a tail piece of a needle thread. The upper half can be pivoted in such a way that a receiving opening for the needle thread is formed in an opened position of the scissors, whereas, in a closed position, the needle thread is cut and the tail piece of the needle thread is clamped and retained between the upper half and the clamping jaw. The upper half can further take a third position in which the tip portion of the upper half is free from the clamping jaw and the tail piece of the needle thread is released.

7 Claims, 5 Drawing Sheets

V
1
53
52
64
54
55
45
51
63
44
94
65
66
31
43
26
98
99
42
58
42
41
87
57
7
46
88
71
40
30
91
92
93
70
z
36
IV
89
69
39
37
y
68
100
33
87
56
16
2
34
35
38

53
64
52
53
54
43
63
55
62
45
51
60
59
VI
86
VI
y
58
85
44
72
71
56
x
70
57
37
31
42

51
45
1
49
48
47
50
54
55
32
44
87
52
31
30
98
99
42
72
62
42
57
40
60
59
100
z
x
87
86
34
2

52
54
55
45
63
44
65
64
62
66
z
x
58
61
59
60

BUTTONHOLE SEWING MACHINE, WITH A NEEDLE-THREAD CLAMP AND CUTTER

BACKGROUND OF THE INVENTION

1. Field of the Invention

The invention relates to a sewing machine, and in particular to a buttonhole sewing machine.

2. Background Art

U.S. Pat. No. 4,919,061 teaches a sewing machine, i.e. a buttonhole sewing machine for the sewing of linen buttonholes, which comprises a needle drivable to shuttle up and down along a traveling path, a hook with a stock of thread, and a workpiece clamp for a workpiece to be held and guided under the needle during a sewing job. The workpiece clamp comprises a hole for the needle to pass through when a seam is produced. The workpiece clamp is driven by means of a radial cam, i.e. a group of stitches is sewn, in which the beginning and the end of the seam are close together as is the case with buttonholes. The sewing machine further comprises a needle-thread clamp and cutter which is provided with needle-thread-clamping scissors. These consist of a lower half with a cutting edge located at a tip portion. They further consist of an upper half pivotal relative to the lower half about a pivot hinge and likewise provided with a cutting edge at its tip portion. Finally, the needle-thread-clamping scissors comprise a clamping jaw which is pressed against, and springs towards, the tip portion of the upper half for a tail piece of the needle thread to be clamped and held. Regardless of the two positions of the upper half of the scissors relative to the lower half, the needle-thread-clamping scissors, for execution of their working motion in the direction of the lengthwise extension of the buttonhole to be sewn, must be moved into varying positions relative to the stationary needle. This leads to the fact that the tail piece held in the needle-thread-clamping scissors is comparatively long (approximately 10 mm). As a result, reliable sewing over the tail piece by the starting stitches of a buttonhole then to be produced is not achievable so that the quality of the buttonhole is negatively affected. For the performance of the various motions of the needle-thread-clamping scissors, drive mechanisms are required, which are complicated constructionally and in terms of manufacturing engineering.

U.S. Pat. No. 4,502,404 teaches another needle thread cutter for a buttonhole sewing machine, in which the problems described above also occur.

SUMMARY OF THE INVENTION

It is an object of the invention to embody a sewing machine, in particular a buttonhole sewing machine, which ensures the production of a short needle thread tail piece over which to sew reliably.

According to the invention, this object is attained in a sewing machine, in particular a buttonhole sewing machine, comprising a needle drivable to reciprocate up and down along a traveling path; a hook; a workpiece clamp for holding and guiding a workpiece under the needle during a sewing operation, the workpiece clamp having a recess for a needle to pass through during the production of a seam; a drive for the workpiece clamp; a needle-thread clamp and cutter, which comprises needle-thread-clamping scissors, which are provided with a lower half having a cutting edge at its tip portion, an upper half pivotal relative to the lower half about a pivot hinge and having a cutting edge at its tip portion, and a clamping jaw, which can be pressed elastically on the tip portion of the upper half, for clamping and holding a tail piece of the needle thread, and which takes a working position, in which the cutting edges are positioned at least substantially over the recess of the workpiece clamp; and drive mechanisms for pivoting the upper half in one and the same pivoting direction relative to the lower half from a first opened position, in which the traveling path of the needle extends through a needle-thread-receiving opening formed between the cutting edges, and in which the tip portion of the upper half is released from the clamping jaw, into a second closed position, in which the tip portions lap at least partially, and in which the tip portion of the upper half of the scissors is in thread-clamping engagement with the clamping jaw, and into a third position, in which the tip portion of the upper half is released from the clamping jaw. Due to the attainment of the possibility of pivoting the upper half relative to the lower half of the scissors in one and the same pivoting direction from a first opened position into a second closed position, in which the tail piece is clamped, and into a third position, in which the clamped tail piece is released, the needle-thread clamp and cutter can be disposed comparatively close to the traveling path of the needle. This leads to a comparatively short tail piece to be clamped. In the second position, the tail piece is reliably held between the tip portion of the upper half of the scissors and the clamping jaw, reliable formation of the first stitches of a seam then to be produced thus being ensured. Once the first 5 to 15 stitches of a subsequent seam have been produced, the upper half is moved into its third position, in which the tail piece is released, sewing over the tail piece then taking place in the case of a zigzag seam, for instance a buttonhole seam. When pivoted from the second into the third position, the upper half of the scissors does not cross the traveling path of the needle.

As a result of the development according to which the needle-thread-clamping scissors are movable from a working position into a yielding position, in which the tip portions are free from the traveling path of the needle, the tip portions of the lower half and the upper half of the scissors and the clamping jaw are jointly moved out of the traveling path of the needle. This combines with the further development according to which a cutter for cutting a hole beside the seam is provided, having a cutting knife movable through the recess of the workpiece clamp, and serves to make room for the cutting knife of the cutter for the production of a hole, for instance a buttonhole. In this case it is of special advantage when the further measures, according to which a common drive mechanism is provided for driving the cutter and for simultaneously pivoting the needle-thread-clamping scissors from the working position into the yielding position, ensure that the tip portions of the needle-thread-clamping scissors are out of the traveling path of the cutting knife during the latter's downward motion.

The development, according to which a hook-thread cutter is provided in vicinity to the hook and to the traveling path of the needle and a common cutter drive is provided for the hook-thread cutter and for the pivoting of the upper half from the first position into the second position, ensures that the hook thread and the needle thread are cut simultaneously. In keeping with a further development, the upper half of the scissors is moved into the third position by a special drive. This drive is coupled with the driving mechanism for the workpiece clamp.

Further features, advantages and details of the invention will become apparent from the ensuing description of an exemplary embodiment, taken in conjunction with the drawing.

DESCRIPTION OF THE PREFERRED EMBODIMENT

Figure 1:
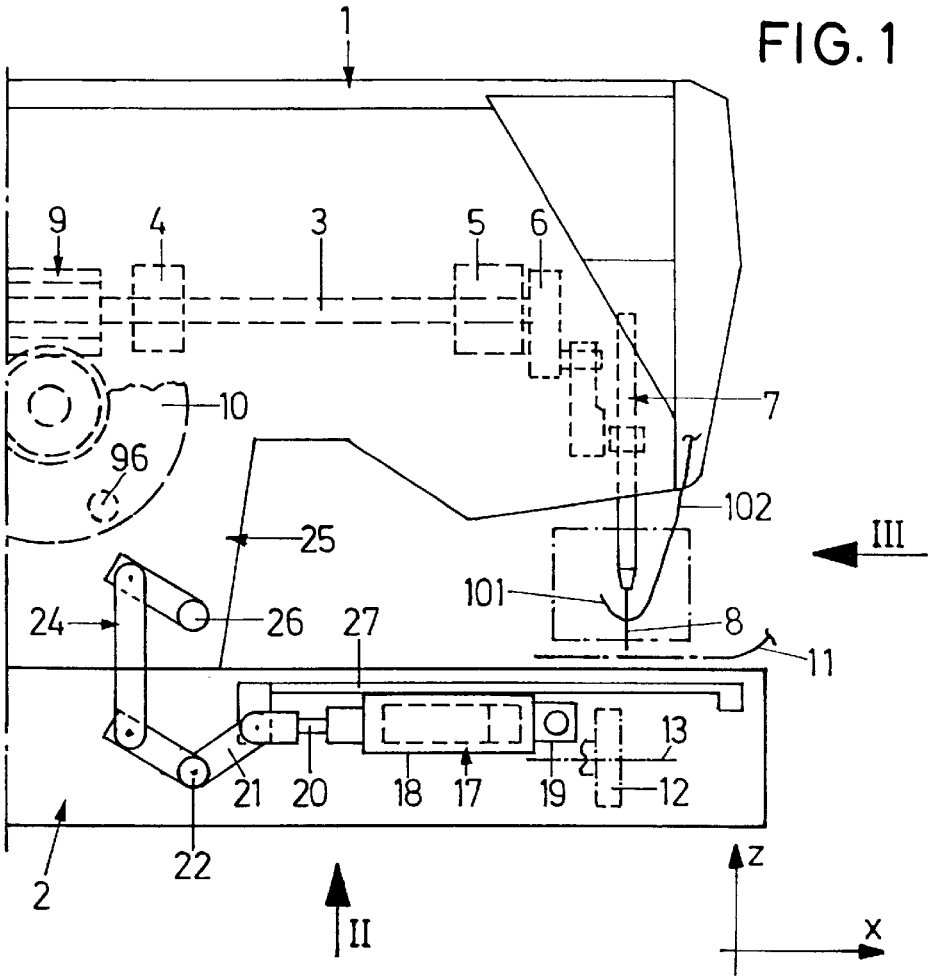
FIG. 1 is a diagrammatic illustration, partially broken open, of a view of the rear of a sewing machine for the sewing of linen buttonholes.
Figure 2:
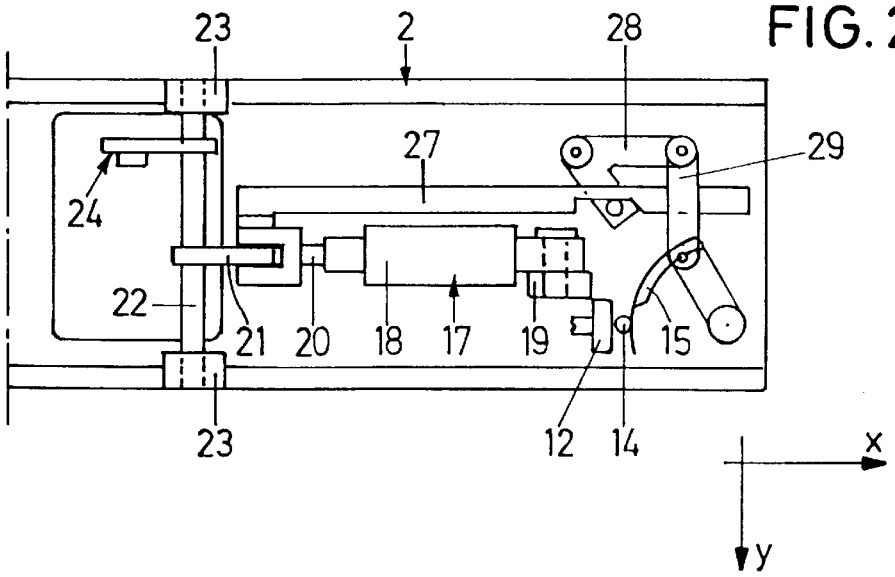
FIG. 2 is a view on to the base plate of the sewing machine according to the arrow II of FIG. 1.

As seen in particular in FIG. 1, a stitch-group-sewing machine of the type of a two-thread lock-stitch machine, in particular a buttonhole sewing machine formed for the sewing of linen buttonholes, generally comprises an arm 1 and a base plate 2. An arm shaft 3 driven in rotation by a drive (not shown) is run in bearings 4, 5 in the arm 1 and, via a crank drive 6, drives a vertically displaceable needle bar 7 with a needle 8 to reciprocate up and down, i.e. in the z direction, along a straight traveling path. Via a worm drive 9, the arm shaft 3 further drives a radial cam 10 from which derives the transport of a workpiece 11 to be sewn during a sewing job. Cam drives of this type are generally known, for instance from U.S. Pat. No. 777,564.

According to FIG. 1, a hook 12 with a stock of thread (not shown) is housed in the base plate 2 for rotation about an axis 13. The drive of the hook 12 is generally derived from the arm shaft 3 synchronously with the motion of the needle bar 7. The hook 12 is formed directly beside a throat cutout 14 formed in the base plate 2 for the needle 8 to reach through into the vicinity of the hook 12. A hook-thread cutter 15 is pivotally disposed directly beside the throat cutout 14. For driving the hook-thread cutter 15 and a needle-thread clamp and cutter 16 still to be described, a common cutter drive 17 is mounted on the underside of the base plate 2, which is a pneumatically actuated piston-cylinder drive. A cylinder 18 is articulated to the base plate by means of a joint 19. Its piston rod 20 is connected with a pivot shaft 22 via a lever 21, the pivot shaft 22 being run in bearings 23 on the base plate 2. Connected with the pivot shaft 22 is an articulated lever system 24, via which a pivotal motion of the pivot shaft 22 is transferred to a shaft 26 lodged in the standard 25 of the sewing machine. The standard 25 generally joins the arm 1 to the base plate 2 of the sewing machine. A motion of the device 16 is derived from the shaft 25 in a manner still to be described. Further, a connecting rod 27 is connected with the piston rod 20 of the drive 17, via an angle lever 28 and a push-pull rod 29 articulated thereto leading the hook-thread cutter 15 in a pivotal motion past the throat cutout 14 with a hook thread being cut. So, cutting a hook thread and cutting a needle thread takes place simultaneously and synchronously.

Figure 4:
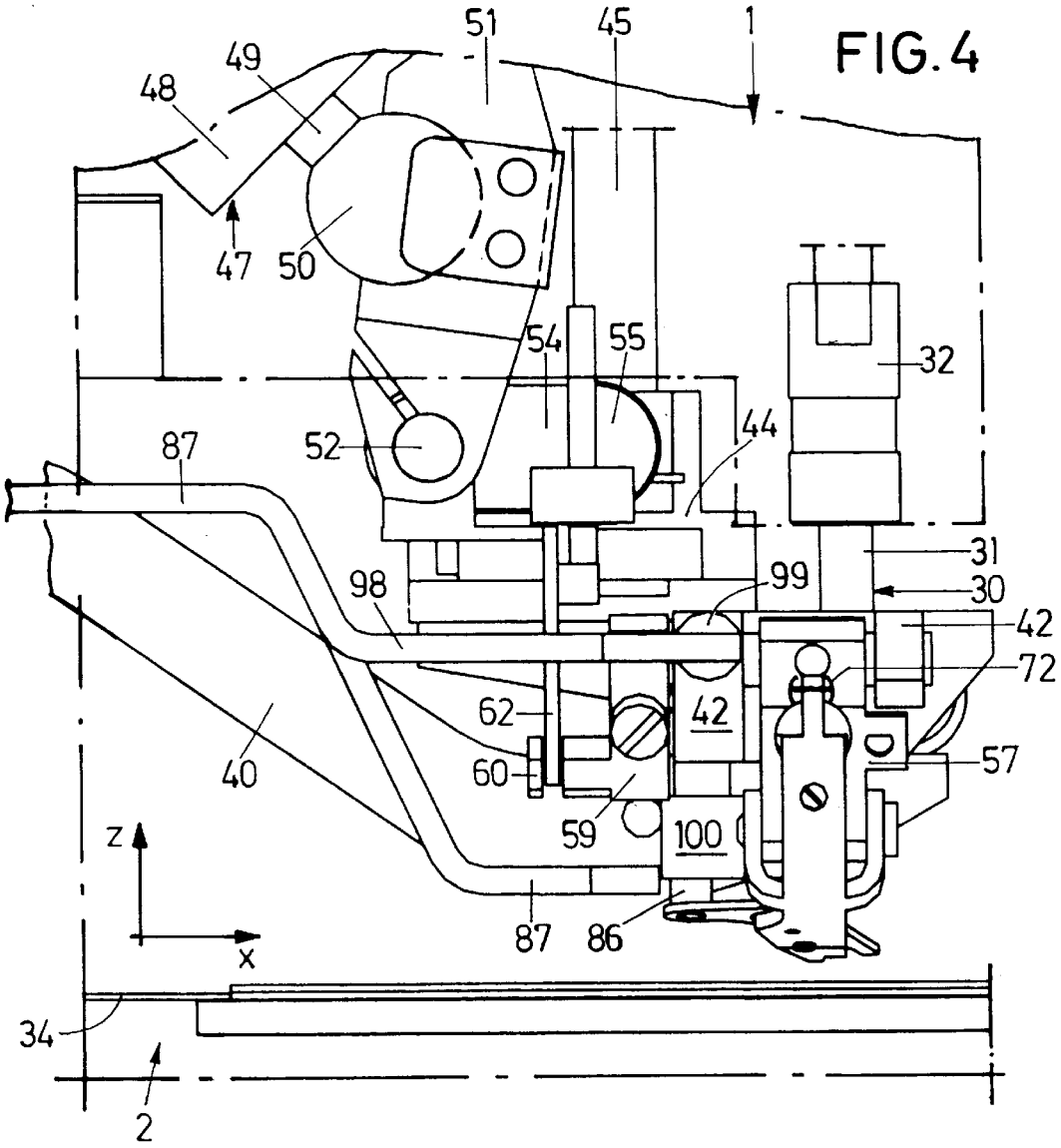
FIG. 4 is an illustration, according to the arrow V of FIG. 3, of a partial section of the sewing machine.
Figure 6:
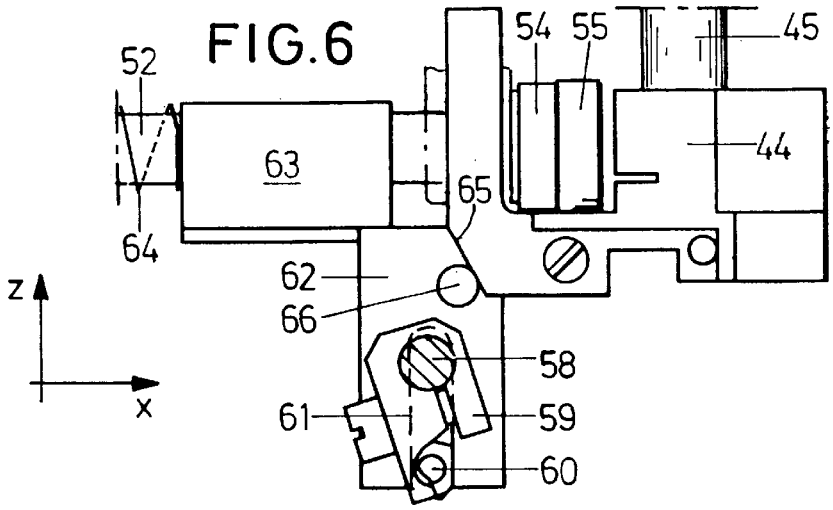
FIG. 6 is a cross-section, on the section line VI—VI of FIG. 5, of the subassembly seen in FIGS. 3 and 5.

According to FIG. 4, the sewing machine further comprises a presser foot 30 which, by means of a bearing 32, is housed in the arm 1 for displacement up and down, i.e. in the z direction, by means of a fabric-presser bar 31. Its drive is effected in the customary way (not shown). The fabric presser bar 31 and the needle bar 7 are disposed in a y-z plane.

Figure 3:
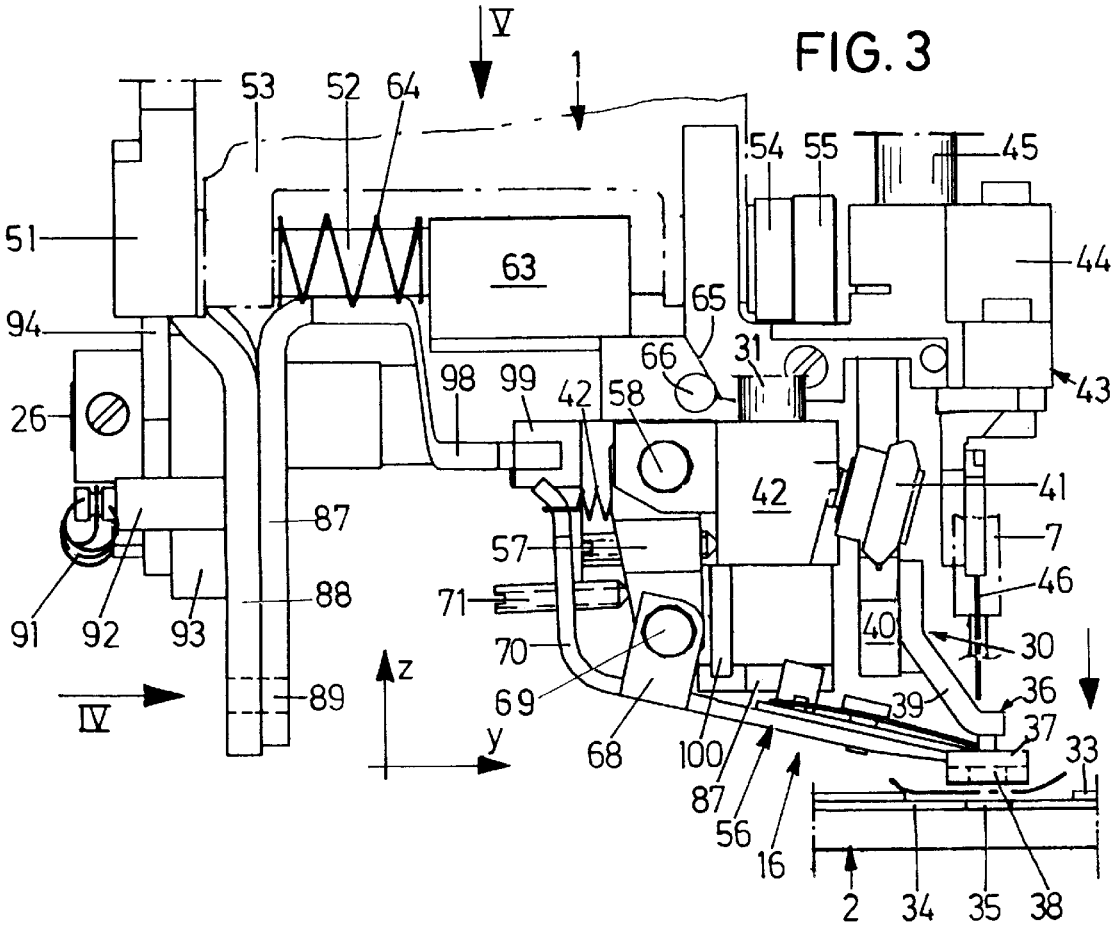
FIG. 3 is a frontal view of the sewing machine according to the arrow III of FIG. 1 on an enlarged scale as compared to FIG. 1, a zone encircled by a dot-dashed line in FIG. 1 being seen in detail.
Figure 7:
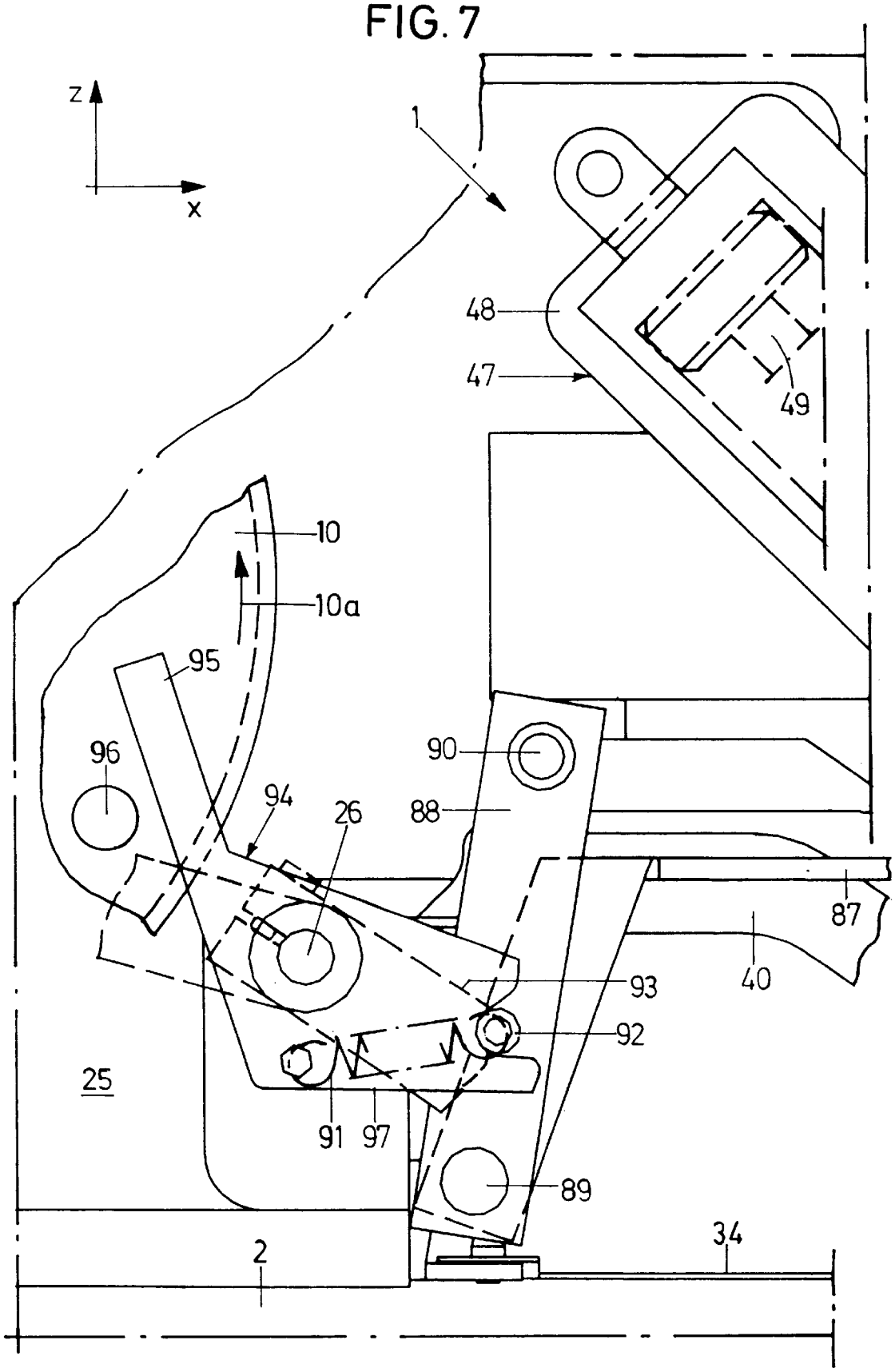
FIG. 7 is a partial illustration, on an enlarged scale, of the zone seen on the left in FIG. 1.

According to FIG. 3, a guide 33 is formed on the base plate 2, which runs in the x direction and in which a workpiece support 34 is guided for displacement in the x direction. The workpiece support 34 has a recess 35 for the needle 8 to pass through and movable to overlap the throat cutout 14. Disposed above the workpiece support 34 is a workpiece clamp 36 by means of which the workpiece 11 can be clamped on the workpiece support 34. The workpiece clamp 36 comprises a strip-type presser plate 37 which extends in the sewing direction, i.e. in the x direction, and which also comprises a recess 38, extending in the x direction, for the needle 8 to pass through. By means of this presser plate 37, the workpiece 11 itself is pressed on the workpiece support 34. The workpiece clamp 36 further comprises a securing bow 39 which is mounted on the presser plate 37 and on a workpiece-clamp carrier 40. As seen in FIG. 7, this carrier 40 is driven by the radial cam 10 in, and counter to, the x direction, i.e. in the sewing direction. Also the workpiece support 34 is coupled with this carrier 40 so that during a sewing operation, the workpiece support 34 and the workpiece clamp 36 are moved in, and counter to, the x direction simultaneously and completely synchronously, i.e. without any motion relative to each other.

The workpiece clamp 36 is forced downwards against the workpiece support 34 by the fabric-presser bar 31 by means of a pressure roller 41 and is released in the z direction when the fabric-presser bar 31 is lifted. The pressure roller 41 is lodged in a bearing piece 42 which is disposed at the lower end of the fabric-presser bar 31.

Figure 5:
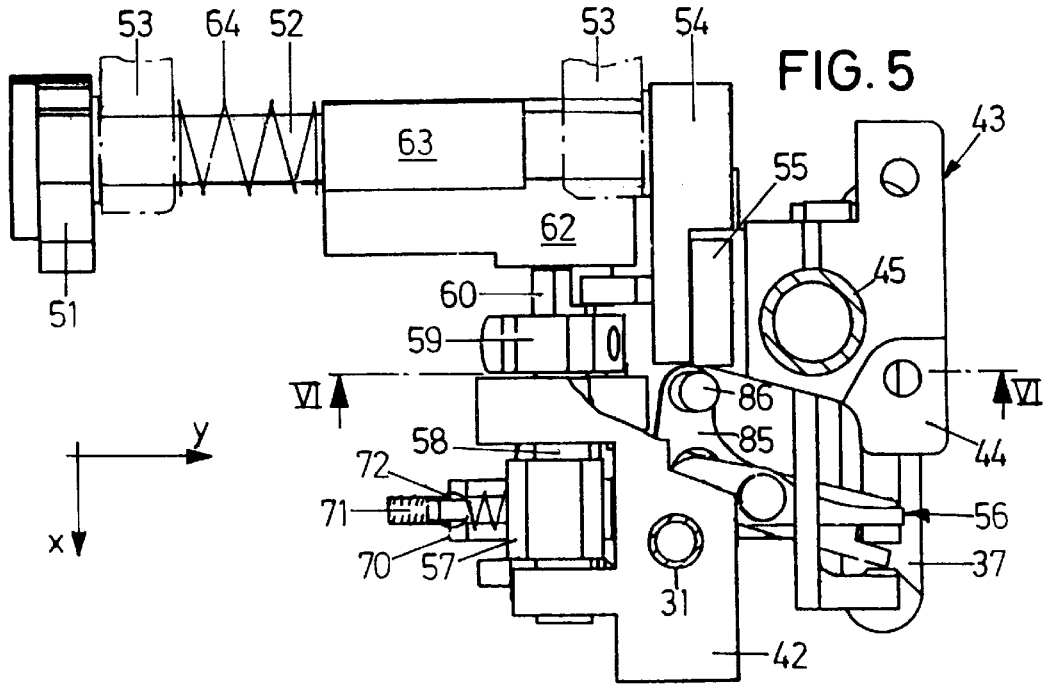
FIG. 5 is a plan view of the subassembly according to the arrow V of FIG. 3.

Furthermore, a buttonhole cutter 43 is disposed in the arm 1, having a cutting-knife carrier 44 which is fixed to a guide rod 45, the latter being lodged in the arm 1 for displacement in the z direction. Mounted on the cutting-knife carrier 44 is a cutting knife 46, by means of which a buttonhole is cut after the sewing of a buttonhole seam. According to FIGS. 4 and 7, the drive of the cutter 43, i.e. of the cutting-knife carrier 44 with the cutting knife 46, is effected by means of a cutting-knife drive 47 which is a piston-cylinder drive pneumatically actuated on both sides. The cylinder 48 of this drive 47 is articulated in the arm 1, while its piston rod 49 is connected with a driving lever 51 via ajoint 50. This driving lever 51 is tightly connected with a driving shaft 52 which is pivotally run is bearings 53 in the arm 1. As seen in particular in FIG. 5, a transfer lever 54 is tightly mounted on the end, opposite to the driving lever 51, of the driving shaft 52 and presses from above against the cutting-knife carrier 44 by means of a pressure roller 55. When the cutting-knife drive 47 is operated in such a way that the piston rod 49 is extended out of the cylinder 48, then the transfer lever 54, by means of the pressure roller 55, forces the cuttingknife carrier 44 with the cutting knife 46 downwards and cuts the buttonhole. The return motion of the cutting knife 46 in the z direction is effected by a pre-stressed compression spring (not shown in the drawing) which is disposed in the arm 1, acting on the guide rod 45.

Figure 10:
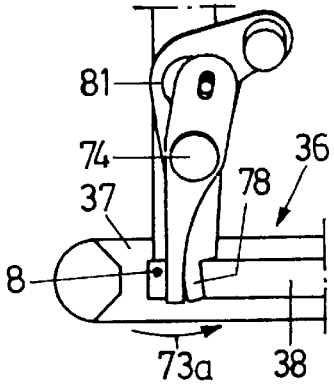
FIG. 10 is an illustration of the pair of needle-thread-clamping scissors when working in its third position of release.

According to FIGS. 3 to 6, the needle-thread clamp and cutter 16 comprises a pair of needle-thread clamping scissors 56 which will still be described in detail; it is lodged on the bearing piece 42, which is connected with the fabric-presser bar 31, to be pivotal about an axis 58 extending in the x direction with a pivoted lever 57 being interconnected. By this lever 57 being pivoted, the scissors 56 can be moved in the y direction out of a working position (FIG. 3) into a yielding position (FIG. 12) and vice versa. This pivoted lever 57 is pivoted by means of a lever 59 which is mounted on the axis 58 and which, by way of a journal 60, engages with a slit 61 of a coulisse 62. The latter is fixed to a sliding bearing 63 which is displaceable on the driving shaft 52 in the latter's longitudinal direction and which is loaded in the y direction by means of a pre-stressed compression spring 64. An adjusting cam 65, which is tightly joined to the cutting-knife carrier 44, bears against the coulisse 62 formed of a sheet. This adjusting cam 65 bears against a journal 66 mounted on the coulisse 62. Upon downward motion of the cutting-knife carrier 44, the coulisse 62 and the sliding bearing 63 are displaced against the force of the pre-stressed compression spring 24 counter to the y direction—to the left in FIGS. 3, 5 and 6—whereby the pivoted lever 57 is pivoted in the same direction—to the left in FIG. 3—whereby the scissors 56 are displaced counter to the y direction. This takes place in such a way that the scissors 56 are positioned at a distance from the recess 38 of the workpiece clamp 36, as seen in FIG. 10. When the buttonhole cutter 43 is operated, i.e. when the cutting knife 46 is moved downwards for a buttonhole to be cut, the scissors 56, by mechanical coupling, are simultaneously moved out of the area of the recess 38 through which the buttonhole is cut in the workpiece 11, i.e. through which the workpiece 11 is provided with a lengthwise cut.

The scissors 56 comprise a lower half 67 which is articulated to the lower end, opposite to the axis 58, of the pivoted lever 57 by means of a forked bearing arm 68 and a bearing bolt 69, the axis 58 and the bearing bolt 69 —as seen in FIG. 3—being disposed one above the other in the z direction. The lower half 67 has a working arm 70 which is angled upwards and in which a set screw 71 is adjustably disposed, bearing against the pivoted lever 57. Further, a pre-stressed re-adjusting spring 72 engages between the pivoted lever 57 and the working arm 70 and moves the working arm 70 and thus the lower half 67 and thus the entire scissors 56 into a position relative to the pivoted lever 57 in which the set screw 71 bears against the pivoted lever 57.

An upper half 73 of the scissors is articulated to the lower half 67 by means of a scissors hinge 74 about which the halves 67, 73 are pivotal relative to each other. In the vicinity of their tips, the halves 67, 73 each have a cutting edge 75 and 76, respectively, which cooperate to make a cutting motion when performing a cutting operation. In the vicinity of these cutting edges 75, 76, the halves 67, 73 each have comparatively slim tip portions 77, 78. A clamping spring 79 of the type of a leaf spring is disposed on the upper half 73; it is connected with the halves 67 and 73 likewise by means of a scissors hinge 74. It cannot be pivoted about the scissors hinge 74 relative to the lower half 67. To this end, it is retained by means of a fixing pin 80 which is mounted on the lower half 67 and passes through a sufficiently sized hole 81 in the upper half 73 and engages in an oblong hole 82 in the upper half 73. The hole 81 in the upper half 73 of the scissors is dimensioned such that the upper half 73 can be pivoted relative to the lower half 67 to the extent necessary. At its end opposite to the fixing pin 80 and turned towards the tip portions 77, 78, the clamping spring 79 possesses a clamping jaw 83. The latter is always located over the tip portion 78 of the upper half 73.

Figure 8:
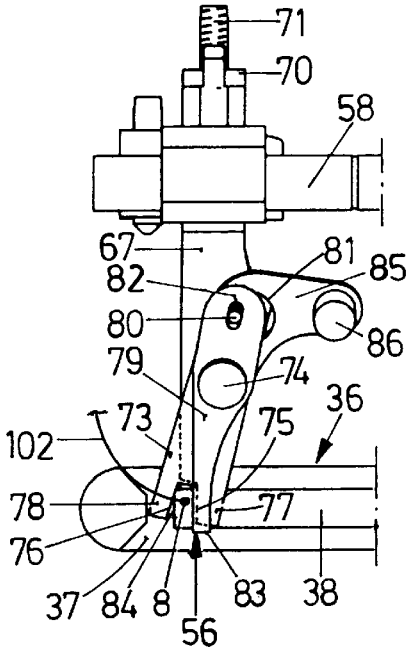
FIG. 8 is an illustration of a pair of needle-thread-clamping scissors when working in its first opened position.
Figure 9:
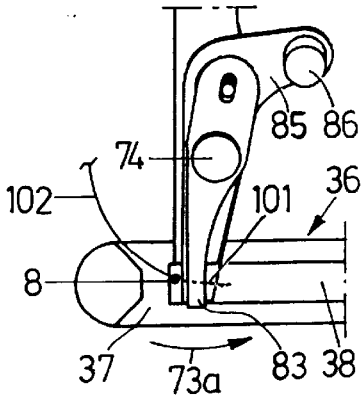
FIG. 9 is an illustration of the pair of needle-thread-clamping scissors when working in its second closed position.

As seen in FIGS. 8 to 10, when in a working position in which the tip portions 77, 78 are over the recess 38, the upper half 73 of the scissors can take a total of three positions relative to the lower half 67. In the first position of the upper half 73 seen in FIG. 8, the scissors 56 are opened, i.e. the cutting edges 75, 76 are spaced, leaving a receiving opening 84 for the needle thread. The tip portion 78 of the upper half 73 is not in engagement with the clamping jaw 83 of the clamping spring 79. In the second (middle) position of the upper half 73 seen in FIG. 9, the receiving opening 84 has been closed, i.e. the cutting edges 75, 76 have been guided past each other, performing a cutting operation, and the tip portion 78 of the upper half 73 is located under the clamping jaw 83 of the clamping spring 79 which is forced against the tip portion 78. In the third position seen in FIG. 10, the upper half 73 is in a position of release of the thread. The importance of the described position will be explained below. For the performance of the described pivot motions of the upper half 73 relative to the lower half 67 of the scissors 56, the upper half 73 has an offset arm 85 with a journal 86, on which acts a control lever 87 which is again articulated to the lower end of a pivoted lever 88 by means of a pivot bearing 89. The pivoted lever 88 is mounted on the arm 1 by means of a stationary bearing 90. A pre-stressed re-adjusting spring 91 acts on the pivoted lever 88, moving the pivoted lever 88 and thus also the control lever 87 into a retracted position. An adjusting journal 92, against which bears a cam lever 93 that is tightly joined to the shaft 26, is mounted on the pivoted lever 88. Upon a pivoting motion —described above —of the shaft 26 by means of the cutter drive 17, the pivoted lever 88, and thus the control lever 87, is moved so far—in the x direction —that the upper half 73 is pivoted from the first position seen in FIG. 8, namely a needle-thread-catching position with the scissors 56 opened, into the second position seen in FIG. 9, which is a position of cutting and clamping of the scissors 56.

In vicinity to the pivoted lever 88, an actuating lever 94 in the form of an angle lever is mounted on the shaft 26 to be freely rotatable relative to the latter. It has an arm 95 which reaches into the area of the radial cam 10 and is allocated to an actuating journal 96 disposed on the radial cam 10. The actuating lever 94 comprises another arm 97 which can be moved into engagement with the adjusting journal 92. When the actuating journal 96 of the radial cam 10, upon rotation of the latter in the direction of rotation 10*a*, i.e. counter-clockwise in the embodiment shown, reaches the arm 95, thus pivoting the actuating lever 94, then the arm 97 pivots the pivoted lever 88 farther than does the cam lever 93. In this case, the upper half 73 is then moved into the third position in which the scissors 56 take a position of release of the needle thread. For the control lever 87 to be able to keep its position relative to the bearing piece 42 in the z direction, it is guided by a joined-on guide piece 98 in a sliding bearing 99 which is guided on the bearing piece 42 for displacement in the x direction.

Returning the upper half 73 into the first opened position, the needle-thread-catching position, is effected by way of a stop 100 formed and disposed on the bearing piece 42. The journal 86 bears against the stop I 00 when the scissors 56 are moved out of engagement with the recess 38 in the way described above during the downward motion of the cutting knife 46, namely from the working position into the yielding position.

Figure 11:
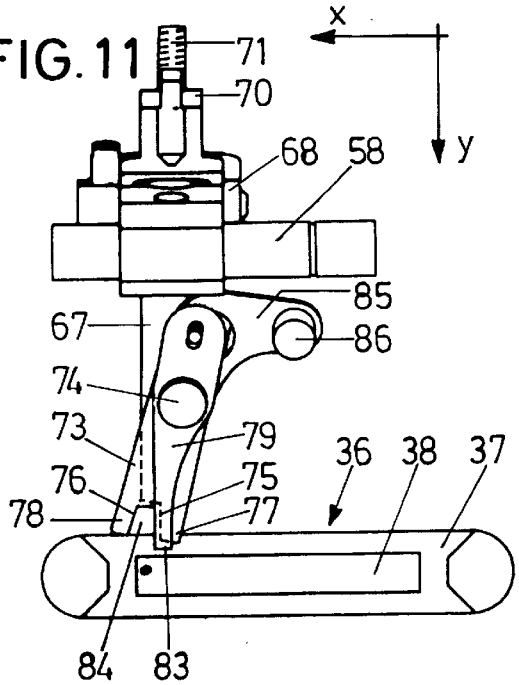
FIG. 11 is an illustration of the pair of needle-thread-clamping scissors when yielding in its first opened position.
Figure 12:
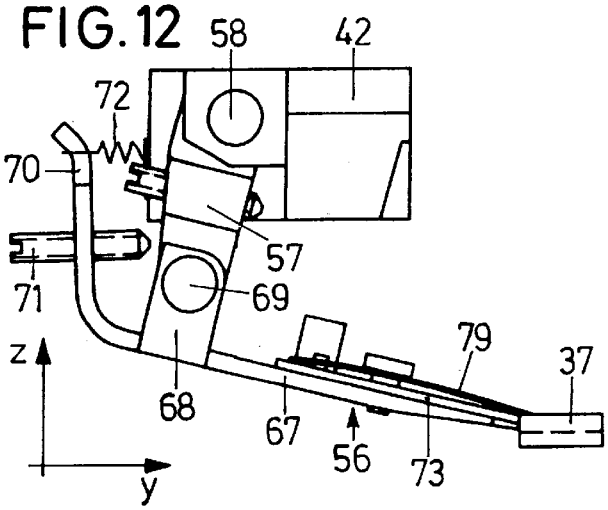
FIG. 12 is a lateral view of the pair of needle-thread-clamping scissors in its yielding position.
Figure 13:
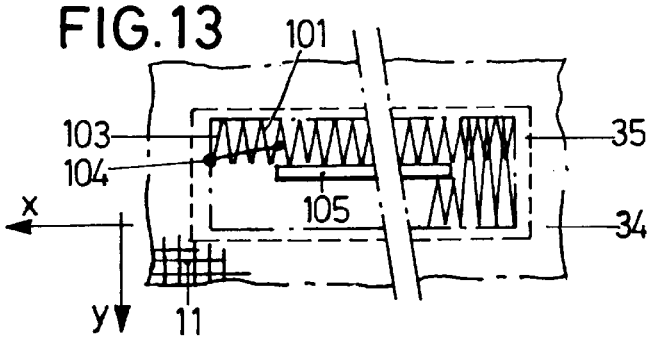
FIG. 13 is an illustration of a workpiece with a linen buttonhole partially sewn.

The way of working is as follows:

According to the illustration in FIG. 9, the scissors 56 are in their working position above the recess 38, the upper half 73 and the lower half 67 being one above the other in their middle, i.e. second, position, in which a tail piece 101 of a needle thread 102 is clamped between the clamping jaw 83 and the tip portion 78 of the upper half 73. A sewing operation is carried out now, the workpiece 11 retained between the workpiece support 34 and the workpiece clamp 36 being displaced in the x direction, which is accompanied with the production of a zigzag seam 103. After some stitches, i.e. after five to fifteen stitches, the actuating journal 96 engages with the arm 95 of the actuating lever 94, whereby the pivoted lever 88 is moved via the cam arm 97 as already described in such a way that the control lever 87 is displaced in the x direction to such an extent that it moves the arm 85 of the upper half 73 in the pivoting direction 73a into the third position, the position of release of the needle thread by the scissors 56 according to the illustration in FIG. 10. Upon this, the clamping of the tail piece 101 between the clamping jaw 83 and the tip portion 78 of the upper half 73 is released. The subsequent stitches are sewn over the tail piece 101, i.e. it is tightly and invisibly fixed in the seam 103. The seam 103 is continued, corresponding to the drive via the radial cam 10, namely in the form of a stitch group, i.e. a closed buttonhole seam as partially illustrated in FIG. 13. When the seam 103 is finished in the vicinity of its starting point 104, the machine comes to a standstill with the needle 8 removed from the workpiece 11. Now the buttonhole 105 is being cut by the cutting knife 46. As described, upon downward motion of the cutting knife 46, the scissors 56 are pivoted counter to the y direction from the position of lapping of the recess 38 of the presser plate 37, i.e. from the working position into the yielding position as illustrated in FIGS. 11 and 12. In this case the scissors 56 are opened in the way described, i.e. the upper half 73 is moved into its first position in which the receiving opening 84 is opened. Upon upward motion of the cutting knife 46 in the z direction, the scissors 56 are moved into their working position with the tip portions 77, 78 located over the recess 38 of the presser plate 37, as seen in FIG. 3 and FIG. 8. In this needle-thread-catching position (first position), the needle thread 102 is in the position seen in FIG. 8. Now the cutter drive 17 is operated, whereby the hook-thread cutter 15 on the one hand and the scissors 56 on the other are actuated. The upper half 73 is moved in the pivoting direction 73*a* into its middle (second) position, the needle thread 102, during this travel, being cut between the two cutting edges 75, 76 and then clamped between the clamping jaw 83 and the tip portion 78 of the upper half 73 as seen in FIG. 9. This corresponds to the starting position for the next sewing job.

What is claimed is:

1. A sewing machine, in particular a buttonhole sewing machine, comprising a needle (8) drivable to reciprocate up and down along a traveling path;

a hook (12);

a workpiece clamp (36) for holding and guiding a workpiece (11) under the needle (8) during a sewing operation, the workpiece clamp (36) having a recess (38) for a needle (8) to pass through during the production of a seam (103);

a drive (10) for the workpiece clamp (36);

a needle-thread clamp and cutter (16), which comprises needle-thread-clamping scissors (56), which are provided with a lower half (67) having a tip portion (77) and a cutting edge (75) at said tip portion (77), an upper half (73) pivotal relative to the lower half (67) about a pivot hinge (74) and having another tip portion (78) and a cutting edge (76) at another said tip portion (78), and a clamping jaw (83), which is pressable elastically on the tip portion (78) of the upper half (73), for clamping and holding a tail piece (101) of needle thread (102), and which takes a working position, in which the cutting edges (75, 76) are positioned at least substantially over the recess (38) of the workpiece clamp (36); and drive mechanisms for pivoting the upper half (73) in one and the same pivoting direction (73*a*) relative to the lower half (67)

from a first opened position, in which the traveling path of the needle (8) extends through a needle thread receiving opening (84) formed between the cutting edges (75, 76), and in which the tip portion (78) of the upper half (73) is released from the clamping jaw (83), into a second closed position, in which the tip portions (77, 78) lap at least partially, and in which the tip portion (78) of the upper half (73) of the scissors is in thread-clamping engagement with the clamping jaw (83), and into a third position, in which the tip portion (78) of the upper half (73) is released from the clamping jaw (83).

2. A sewing machine according to claim 1, wherein the needle-thread-clamping scissors (56) are movable from a working position into a yielding position, in which the tip portions (77, 78) are free from the traveling path of the needle (8).

3. A sewing machine according to claim 1, wherein a cutter (43) for cutting a hole (105) beside the seam (103) is provided, having a cutting knife (46) movable through the recess (38) of the workpiece clamp (36).

4. A sewing machine according to claim 3, wherein the needle-thread-clamping scissors (56) are movable from a working position into a yielding position, in which the tip portions (77, 78) are free from the traveling path of the needle (8), and wherein a common drive mechanism is provided for driving the cutter (43) and for simultaneously pivoting the needle-thread-clamping scissors (56) from the working position into the yielding position.

5. A sewing machine according to claim 1, wherein a hook-thread cutter (15) is provided in vicinity to the hook (12) and to the traveling path of the needle (8) and wherein a common cutter drive (17) is provided for the hook-thread cutter (15) and for the pivoting of the upper half (73) from the first position into the second position.

6. A sewing machine according to claim 5, wherein a separate drive mechanism is provided for pivoting the upper half (73) from the second position into the third position.

7. A sewing machine according to claim 6, wherein the separate drive mechanism is coupled with the drive mechanism for the workpiece clamp (36).

* * * * *